US005230688A

United States Patent [19]

Hatchell et al.

[11] Patent Number: 5,230,688

[45] Date of Patent: Jul. 27, 1993

[54] SERVO DRIVEN COMPONENTS OF A BAG MACHINE

[75] Inventors: Peter J. Hatchell, Franken; Jeffrey L. Ross; Charles A. Sample, both of Green Bay, all of

[73] Assignee: FMC Corporation, Chicago, Ill.

[21] Appl. No.: 430,677

[22] Filed: Nov. 1, 1989 (Under 37 CFR 1.47)

Related U.S. Application Data

[63] Continuation of Ser. No. 387,300, Jul. 28, 1989, abandoned, which is a continuation-in-part of Ser. No. 270,889, Nov. 14, 1988, Pat. No. 5,000,727.

[51] Int. Cl.[5] ..... B65H 29/22

[52] U.S. Cl. ..... 493/193; 493/30; 493/197; 493/209

[58] Field of Search ..... 493/5, 22, 29, 30, 35, 493/36, 193-197, 204, 209

[56] References Cited

U.S. PATENT DOCUMENTS

| | | | |
|---|---|---|---|
| 3,607,550 | 9/1971 | Ballange | 156/358 |
| 4,261,779 | 4/1981 | Wech | 156/251 |
| 4,395,252 | 7/1983 | Lehmacher | 493/28 |
| 4,451,249 | 5/1984 | DeBin | 493/204 |
| 4,573,955 | 3/1986 | Mory et al. | 493/204 |
| 4,735,602 | 4/1988 | DeBin | 493/204 |
| 5,002,522 | 3/1991 | Feustel | 493/1 |
| 5,094,656 | 3/1992 | Hatchell | 493/193 |

FOREIGN PATENT DOCUMENTS

| | | |
|---|---|---|
| 0023117 | 1/1981 | European Pat. Off. . |
| 0297434 | 6/1988 | European Pat. Off. . |
| 2144906 | 9/1971 | Fed. Rep. of Germany . |
| 2328376 | 7/1976 | Fed. Rep. of Germany . |
| 3230816 | 2/1984 | Fed. Rep. of Germany . |
| 1374267 | 11/1974 | United Kingdom . |
| 1440335 | 6/1976 | United Kingdom . |
| 2091450 | 7/1982 | United Kingdom . |
| 2120808 | 12/1983 | United Kingdom . |
| 2176027 | 12/1986 | United Kingdom . |

*Primary Examiner*—Bruce M. Kisliuk
*Assistant Examiner*—Jack Lavinder
*Attorney, Agent, or Firm*—Douglas W. Rudy; Richard B. Megley

[57] ABSTRACT

The invention has to do with the modification of well known heat sealing bag machines to increase the production capability of the machines. The use of servo drives for selected components of the bag machine permits the reduction of film acceleration and consequential peak film velocity, thus allowing faster machine cycles at the same film acceleration and consequential film velocity.

2 Claims, 13 Drawing Sheets

FIG_3A
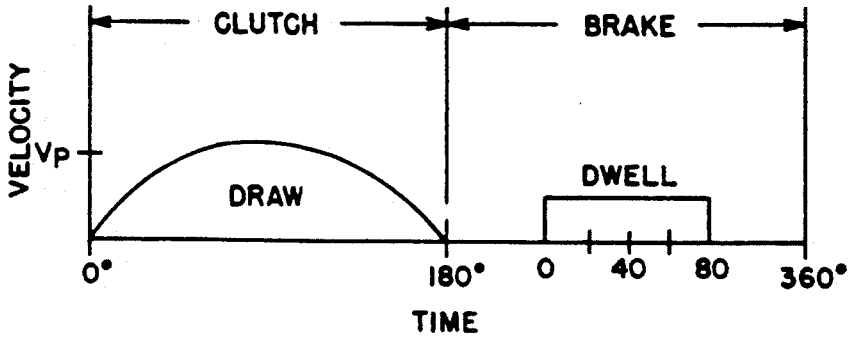
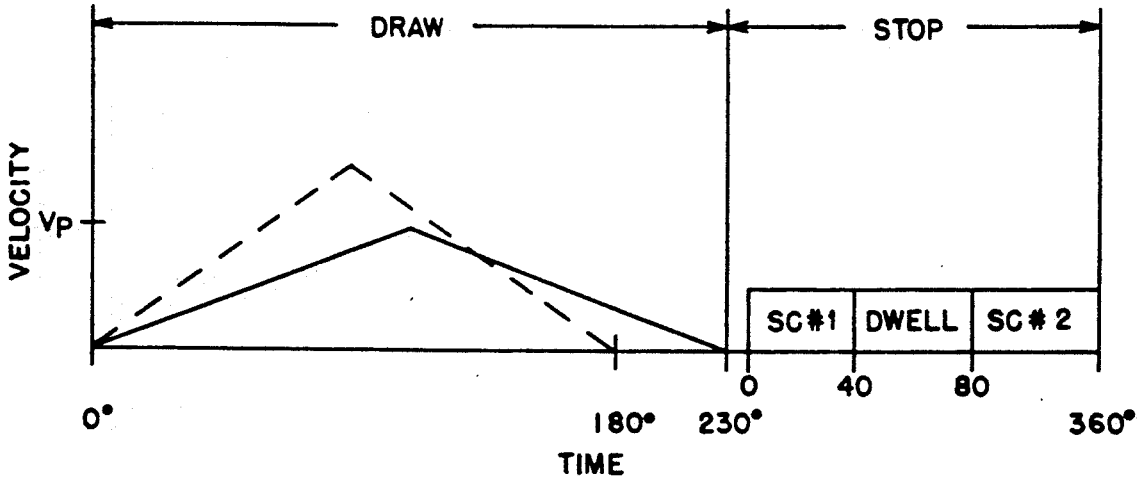
FIG_3B

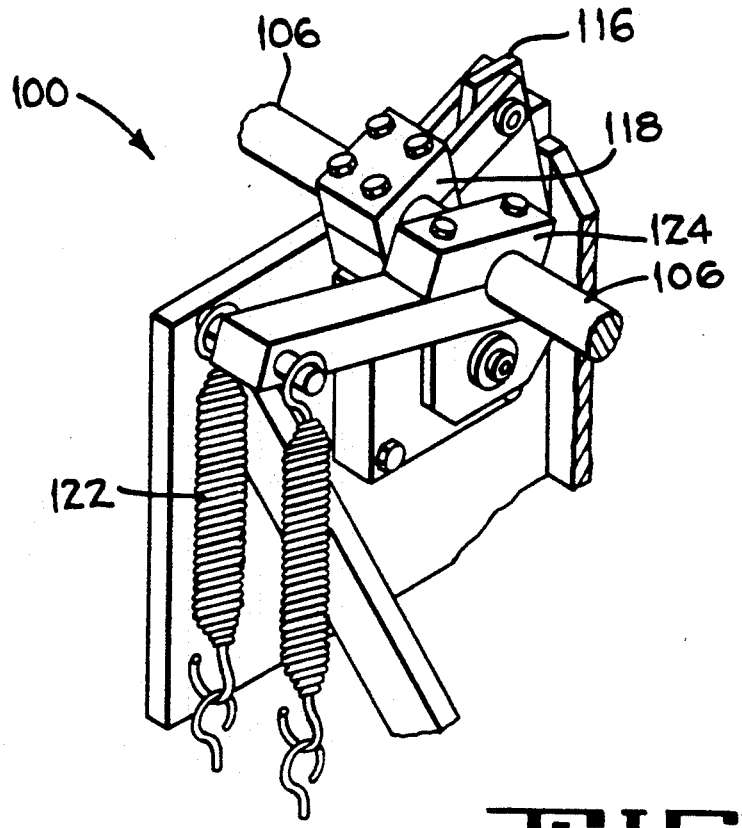
FIG_8A
FIG_8B
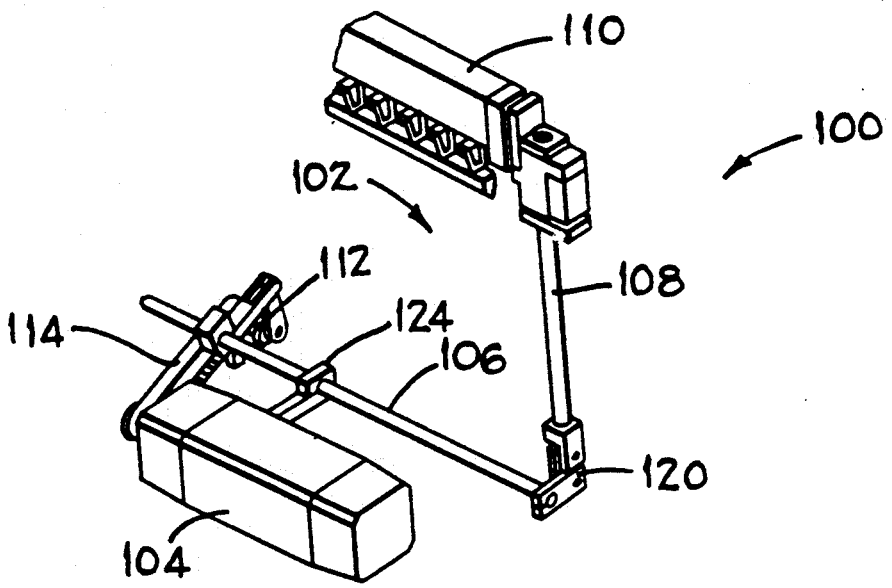

FIG_9
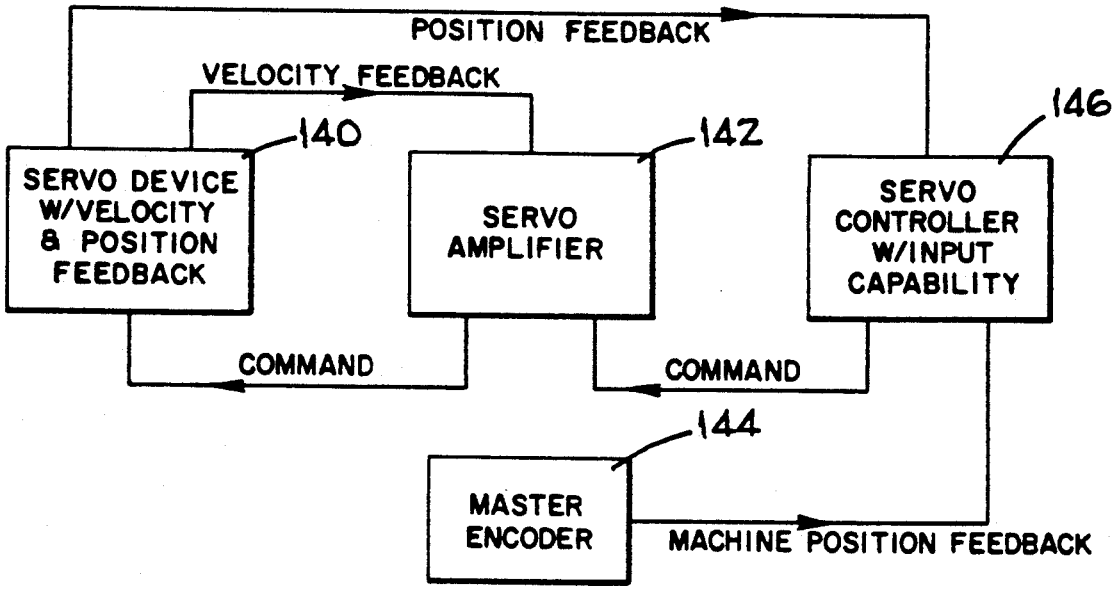
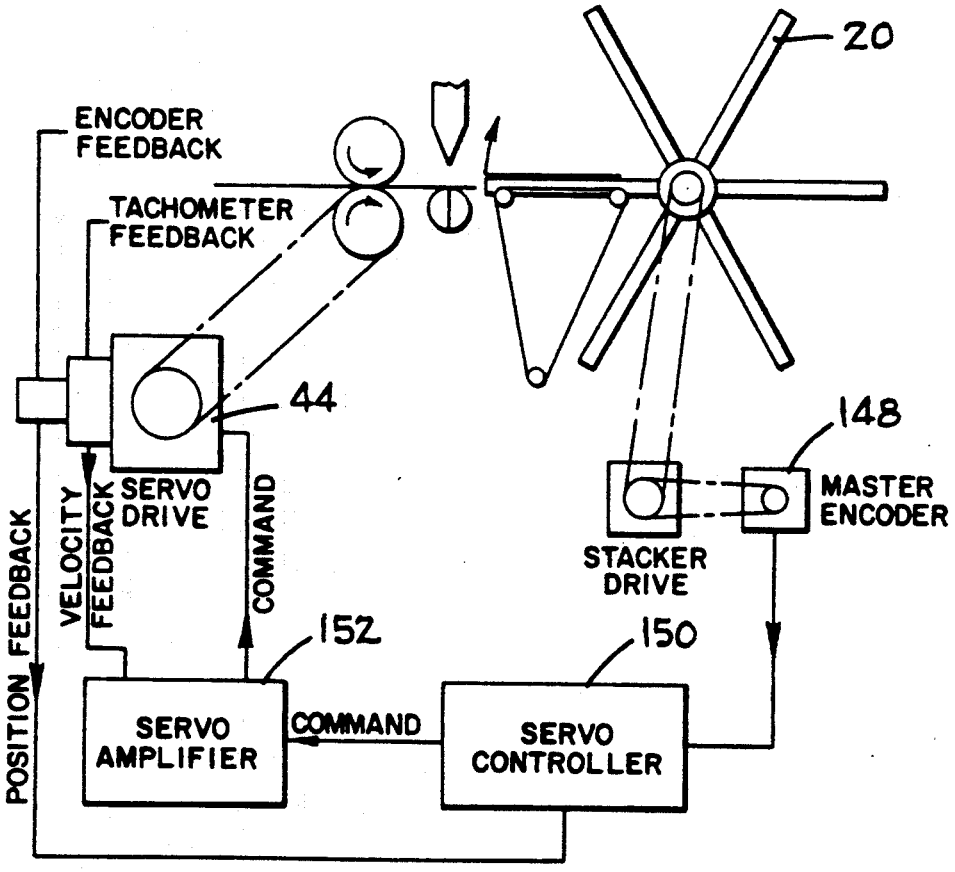
FIG_10

FIG_13D
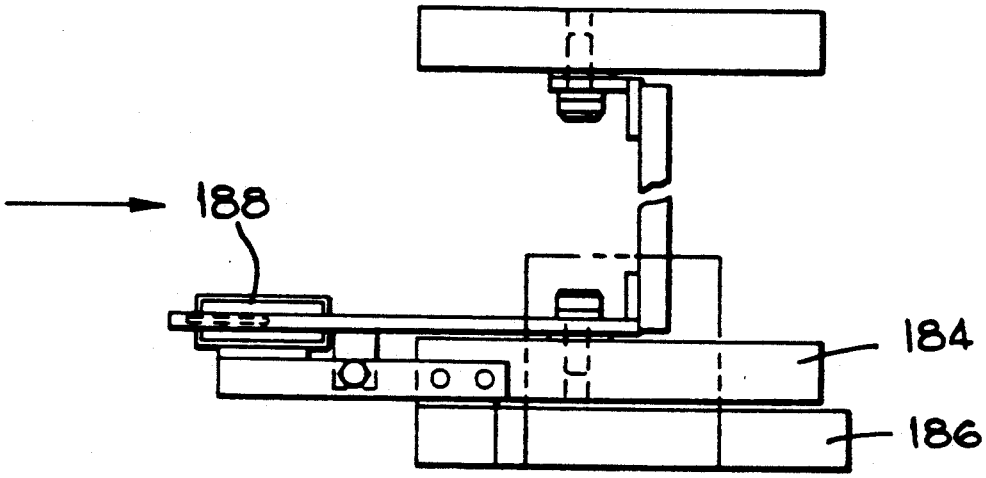
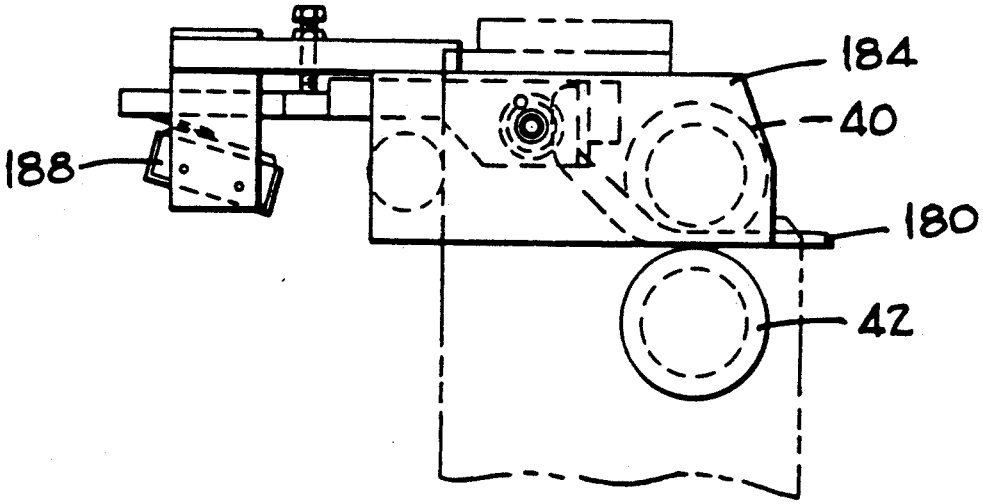
FIG_13E

SERVO DRIVEN COMPONENTS OF A BAG MACHINE

BACKGROUND OF THE INVENTION

This is a continuation under 35 USC 111 and 37 CFR 1.53 of co-pending U.S. application Ser. No. 07/387,300, filed Jul. 28, 1989 now abandoned which is a continuation-in-part of U.S. application Ser. No. 07/270,889, U.S. Pat. No. 5,000,727, filed Nov. 14, 1988 by Peter Hatchel, et al., and assigned to the assignee hereof. Further reference is made to co-pending application Ser. No. 07/269,820 filed Nov. 10, 1988 by Peter Hatchel, et al., the disclosures of all said applications being incorporated by reference herein.

This invention has to do with the modification of well known bag making machines to increase the production capability of such bag machines. The "poly" bag making industry is a well developed industry with numerous bag machine styles competing for a share of the market. A typical bag making machine is the FMC Corporation Model 175W bag making machine which produces "side weld" poly bags and stacks the completed bags using a "wicket", as is well known in the art.

The "175W" is equipped with a main drive electric motor that drives a main drive shaft. Moving elements such as draw rolls, seal head and the wicket are driven by the main drive motor. The draw rolls, which pull a web of film from a supply of film (either a roll of film or a continuously extruded web of film) are driven by a gear and pulley system utilizing a crank and rocker linkage to a segment gear, which utilizes a well known conventional clutch/brake system to convert a reciprocating motion into a reversible one direction rotary motion. The motion produced by this "clutch/brake means" is a harmonic motion that, based on the various gear ratios, will yield a web acceleration and consequential maximum film web velocity as the film web is drawn through the draw rolls, for any given number of machine cycles, as determined by a single rotation of the main cam shaft. This will be discussed further on in this Specification.

It is desirable to increase bag machine production; however, the aforesaid film dynamics, and in particular the acceleration and consequential peak web velocity, have been a limiting factor.

The invention presented herein is an advantage over current production bag machines in that the film acceleration, and consequential peak film velocity, for any given machine speed (cycles per minute) has selectively been reduced, thus allowing faster machine cycles at the same film acceleration and consequential peak film velocity.

In addition, the use of servo drives for selected components of the bag machine permits substantial degrees of freedom heretofore unachievable by the prior art structures and methodologies. For example, for such components as the seal head, the position and motion parameters can be controlled independent of the machine speed or other components of the bag machine.

The advantage of this technology also directly applies to existing "conventionally" driven bag machines similar to the Model 175W mentioned above. Using the invention disclosed herein, it is apparent that the technology can be directly applied to the conventional machines, with some serious machine modifications, to enable the prior existing machines to increase their levels of production to those accomplishable by a current production servo draw roll and seal roll drive machine.

BRIEF DESCRIPTION OF THE DRAWING FIGURES

The invention herein will be easily understood when the specification is read in conjunction with the accompanying figures wherein:

FIG. 3A is a chart showing one machine cycle of a prior art machine;

FIG. 3B is a chart showing one machine cycle of the instant invention machine.

Figure 5A:
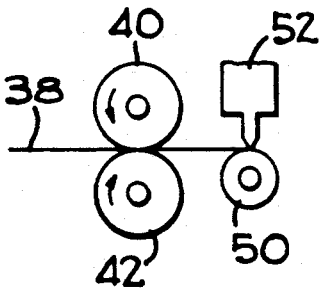
Figure 5B:
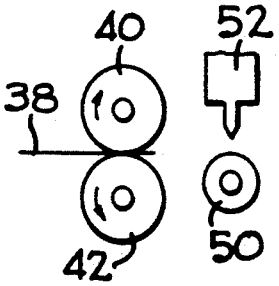
Figure 5C:
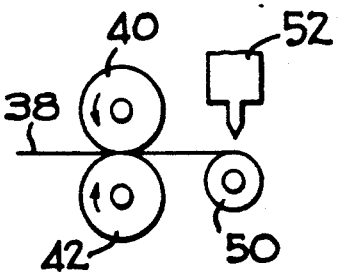
Figure 6:
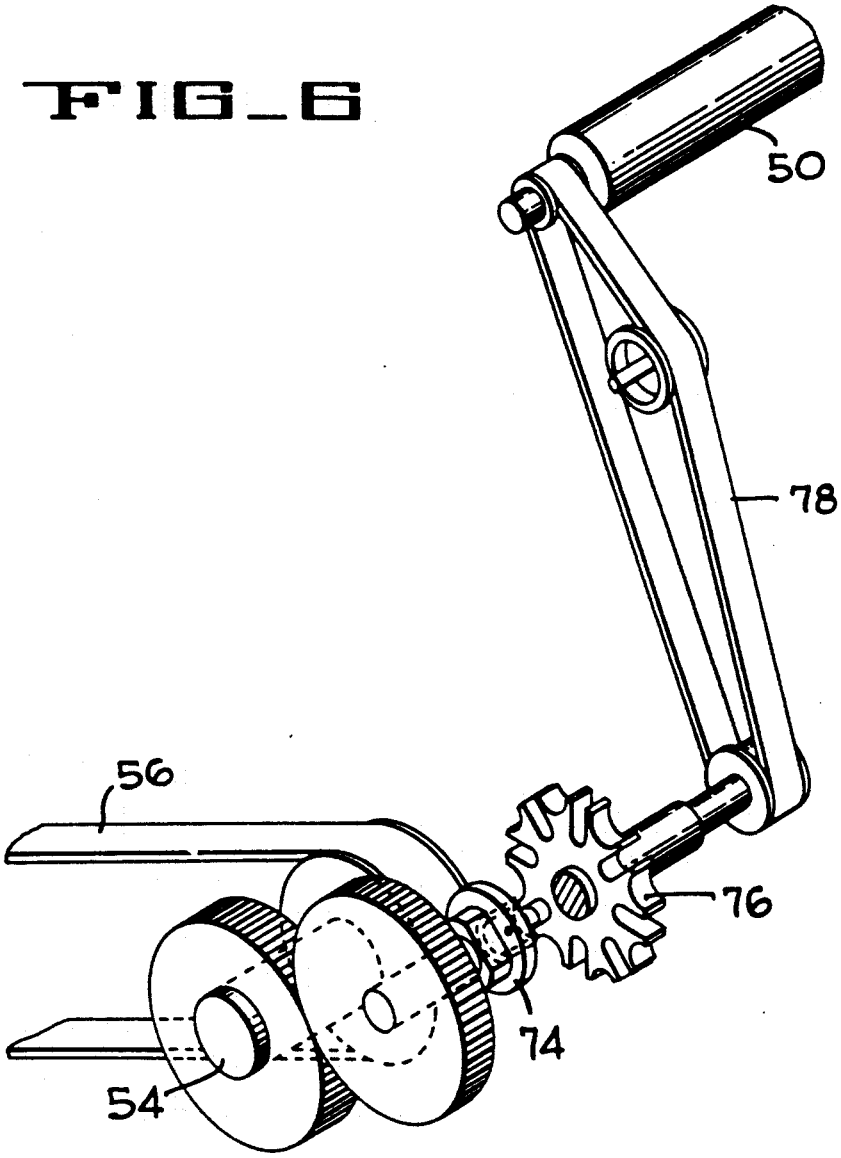

FIG. 5A, 5B, and 5C are diagrammatic presentations of draw rolls during a "cycle interrupt" cycle;

FIG. 6 is a partially broken away section of a geneva gear means; and

Figure 7:
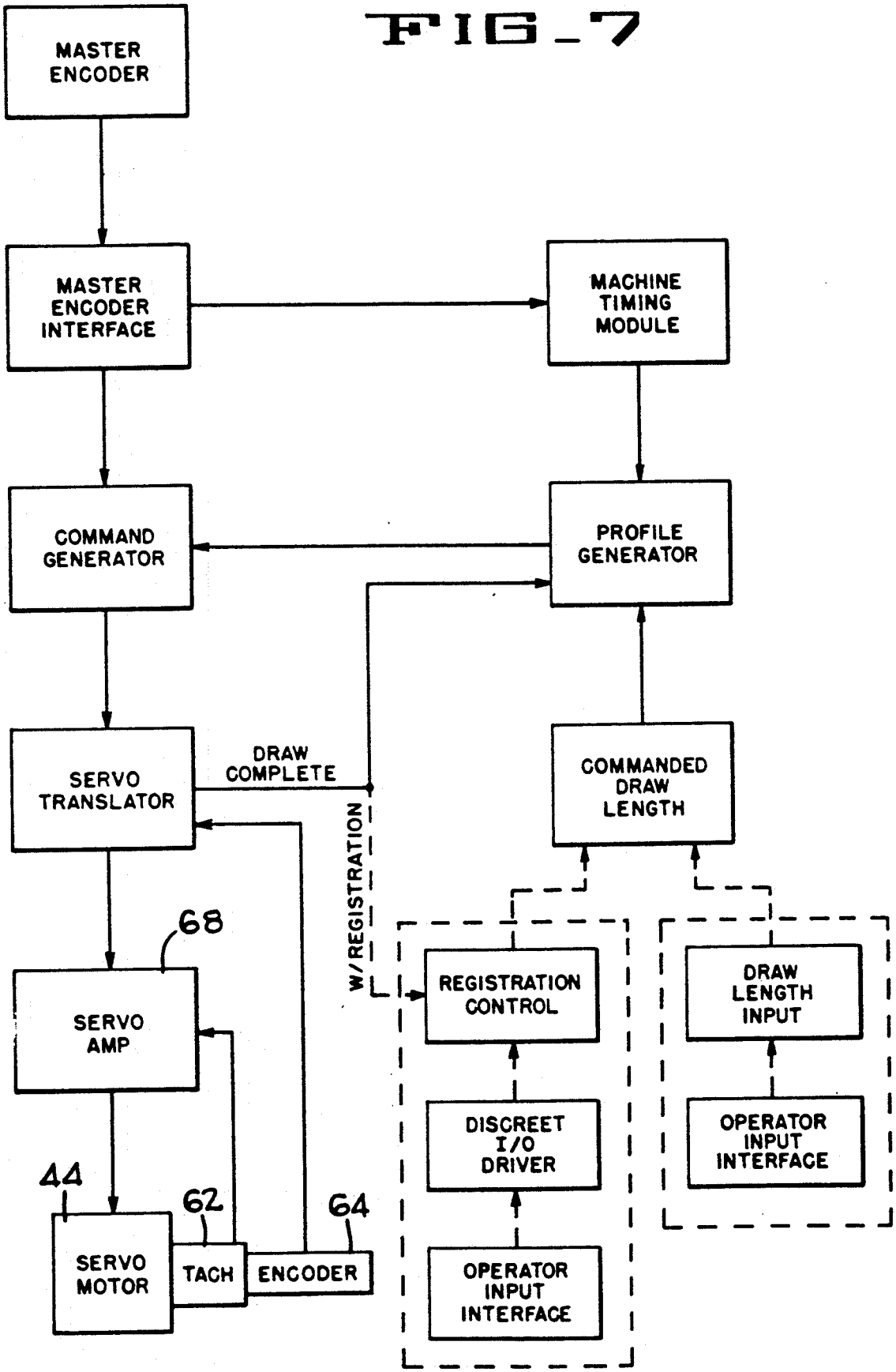

FIG. 7 is a chart showing the electrical interrelationships among various control components and elements of the invention.

FIGS. 8A–8D are fragmentary perspective views of alternate embodiments of a servo driven sealing head mechanism.

FIG. 9 is a simplified block diagram of a servo control system incorporated in one embodiment of the bag making machine.

FIG. 10 is a simplified diamgramatic representation of a ratioing control system for matching the speed of the draw rolls to the speed of the wicketing assembly.

Figure 11:
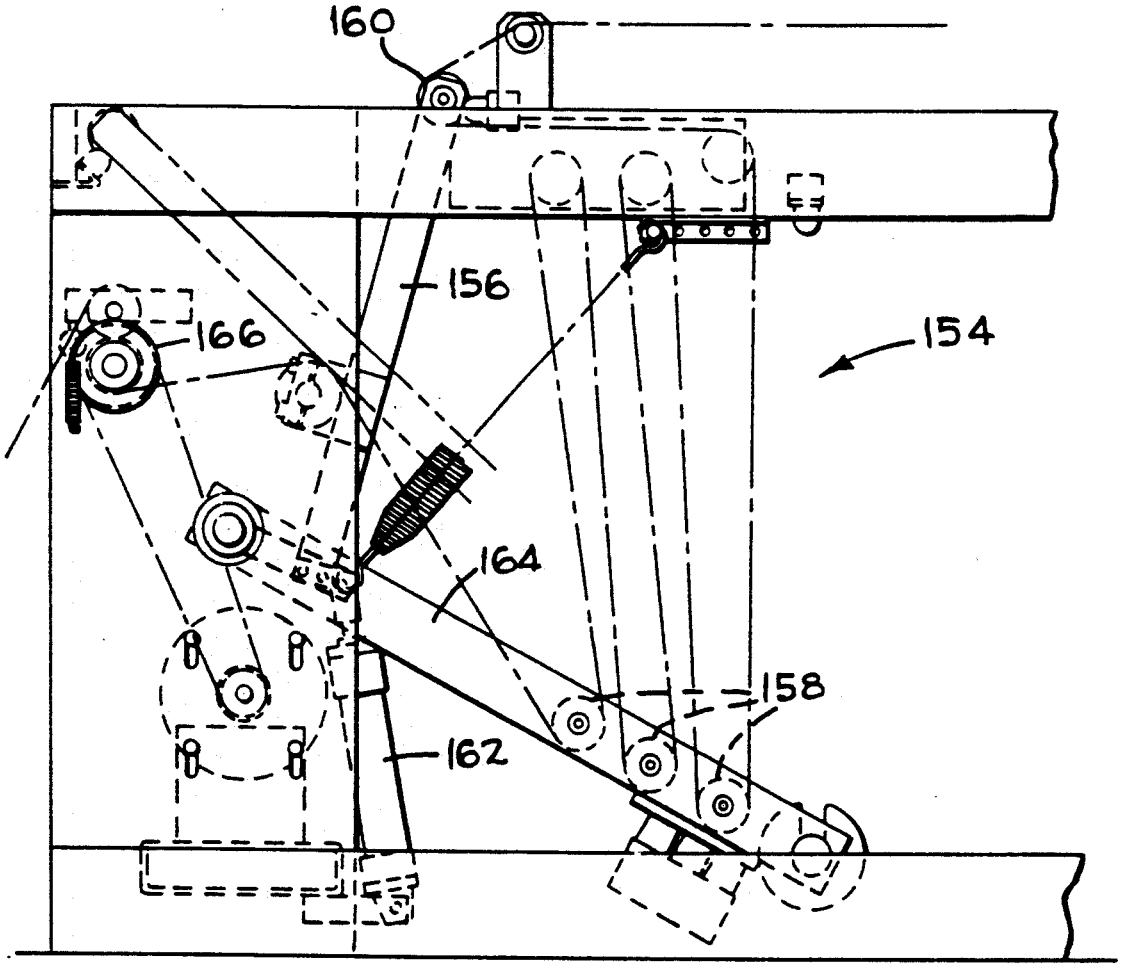

FIG. 11 is a diagramatic representation of one embodiment of the bag machine employing a single roll dancer assembly.

Figure 12:
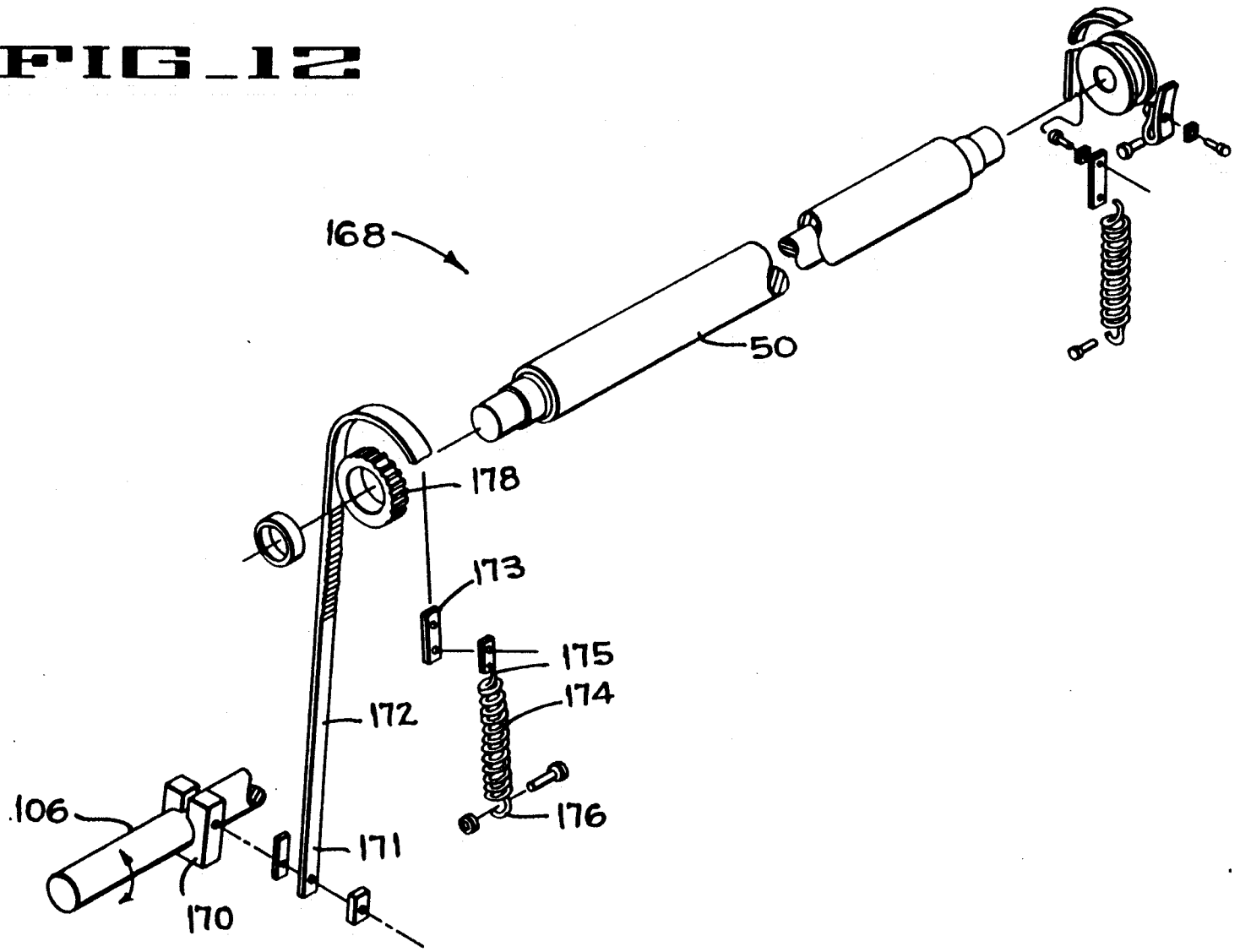
Figure 13B:
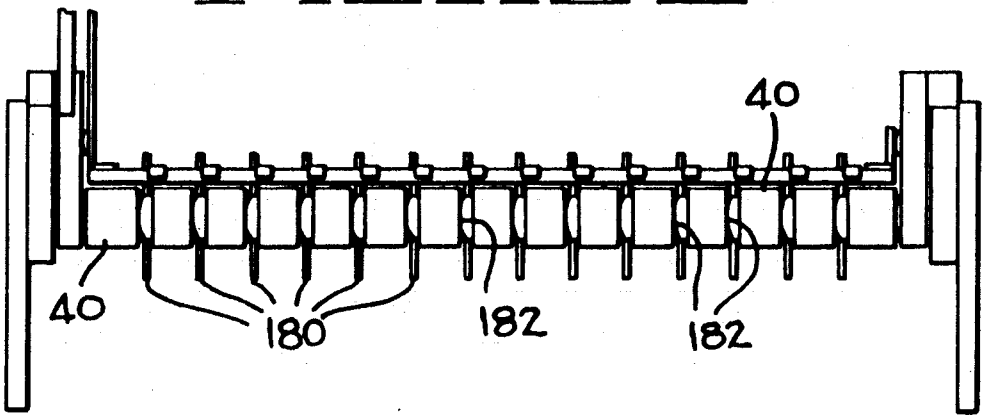
Figure 13C:
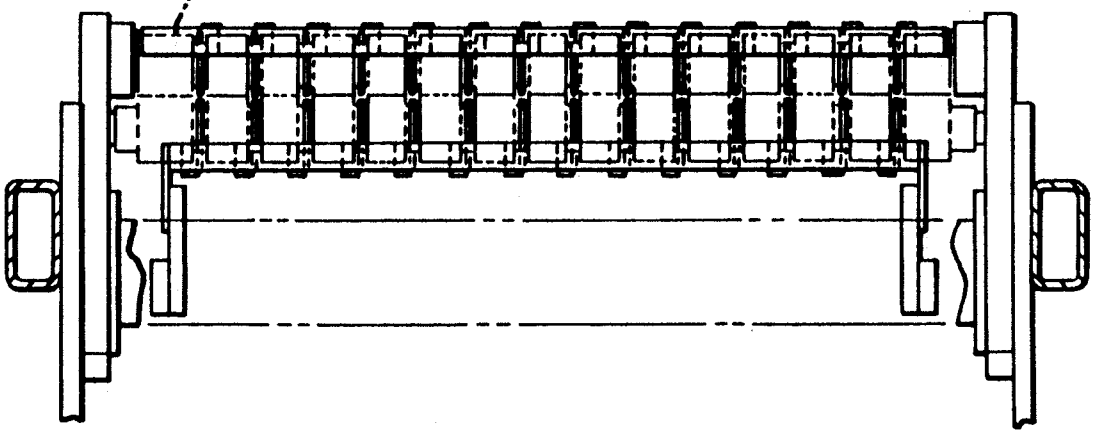
Figure 13A:
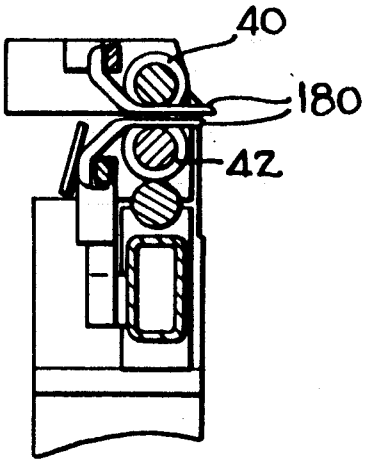

FIG. 12 is an exploded perspective view of a seal roll indexing assembly incorporated in one embodiment of the bag machine.

FIGS. 13A–13E are plan, elevation and cross-sectional views of the bagging machine draw rolls, useful in understanding the operation of a anti-jamming stripper finger assembly incorporated in one embodiment of the invention.

DETAILED DESCRIPTION OF THE INVENTION

Figure 1:
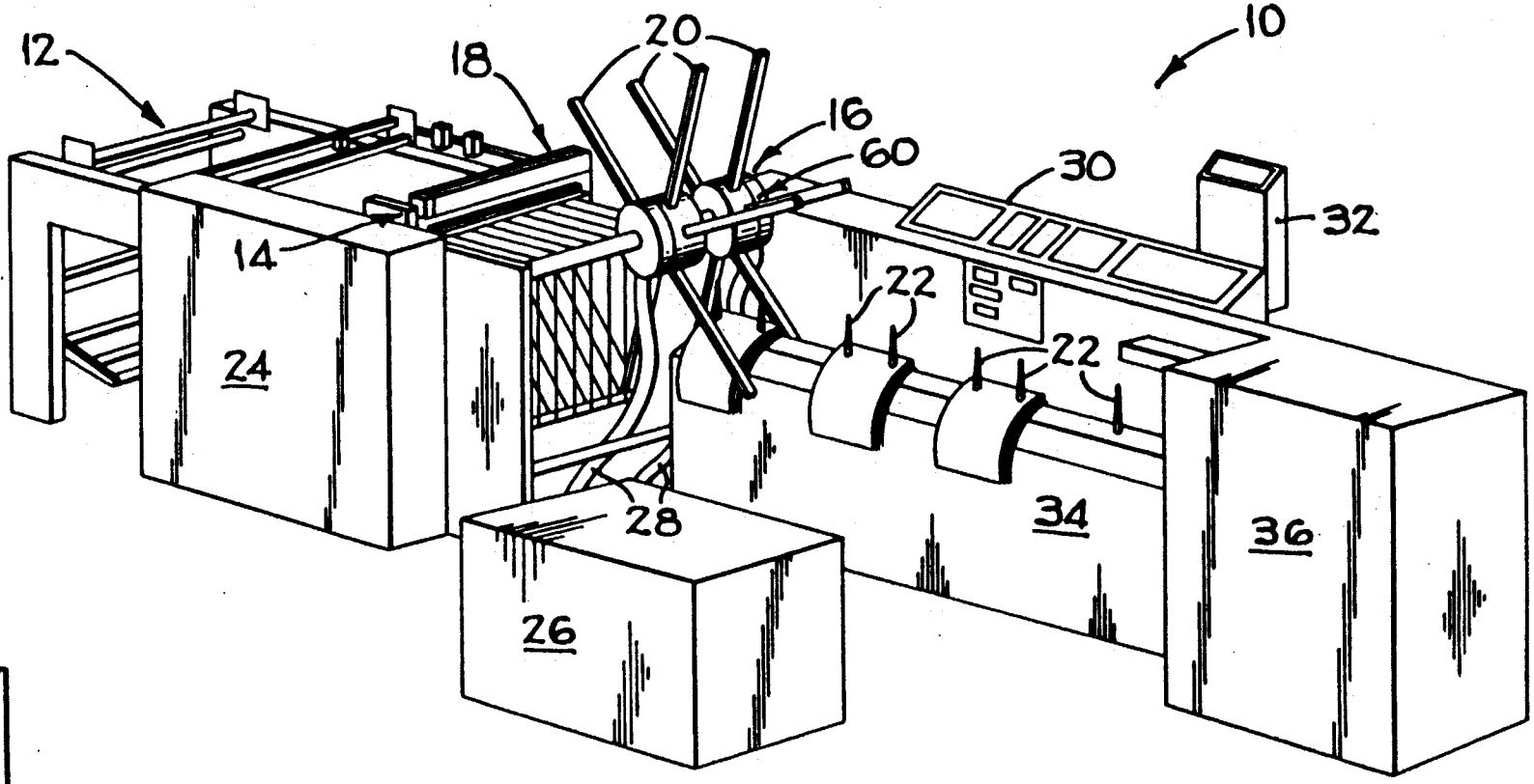
FIG. 1 is a pictorial representation of a bag making machine embodying the invention.

FIG. 1 shows the general environment of the invention in that a bag making machine of a recognizable general configuration is presented. The bag making machine, generally indicated at 10, is made up of a plurality of distinct sections including a tension control and antibounce section, generally 12, a web indexing or bag forming and modifying section, generally 14 and a wicket stacking section, generally 16. A web of film is threaded through the tension control section 12. The web generally originates from a roll of film that has been rolled from a tube of blown/extruded poly material at a remote location in a well known manner. The web is drawn into the bag forming section 14 by a pair of draw rolls that generally includes an upper and lower draw roll providing a nip that grips the web to urge it to a cutting and sealing head 18 while also drawing the film off its storage roll and through the tension control section. After the web has been cut to a desired bag width by the cutting and sealing head 18, which provide the edges defining the width of the bag, the individual bags will be picked up by vacuum on wicket arms 20 and deposited on pins such as 22 in a conventional manner.

The main drive motor for the bag maker, as well as other indexing hardware, is contained in enclosure 24 and in the area under the bag forming section. Enclosure 26 houses vacuum elements from which vacuum is supplied to the vacuum arms 20 by hoses such as 28.

An operator's control panel 30 includes an operator input interface or motion controller 32 that is preferably microprocessor based. A wicket pin conveyor 34 interfaces with an indexing assembly 36.

Figure 2:
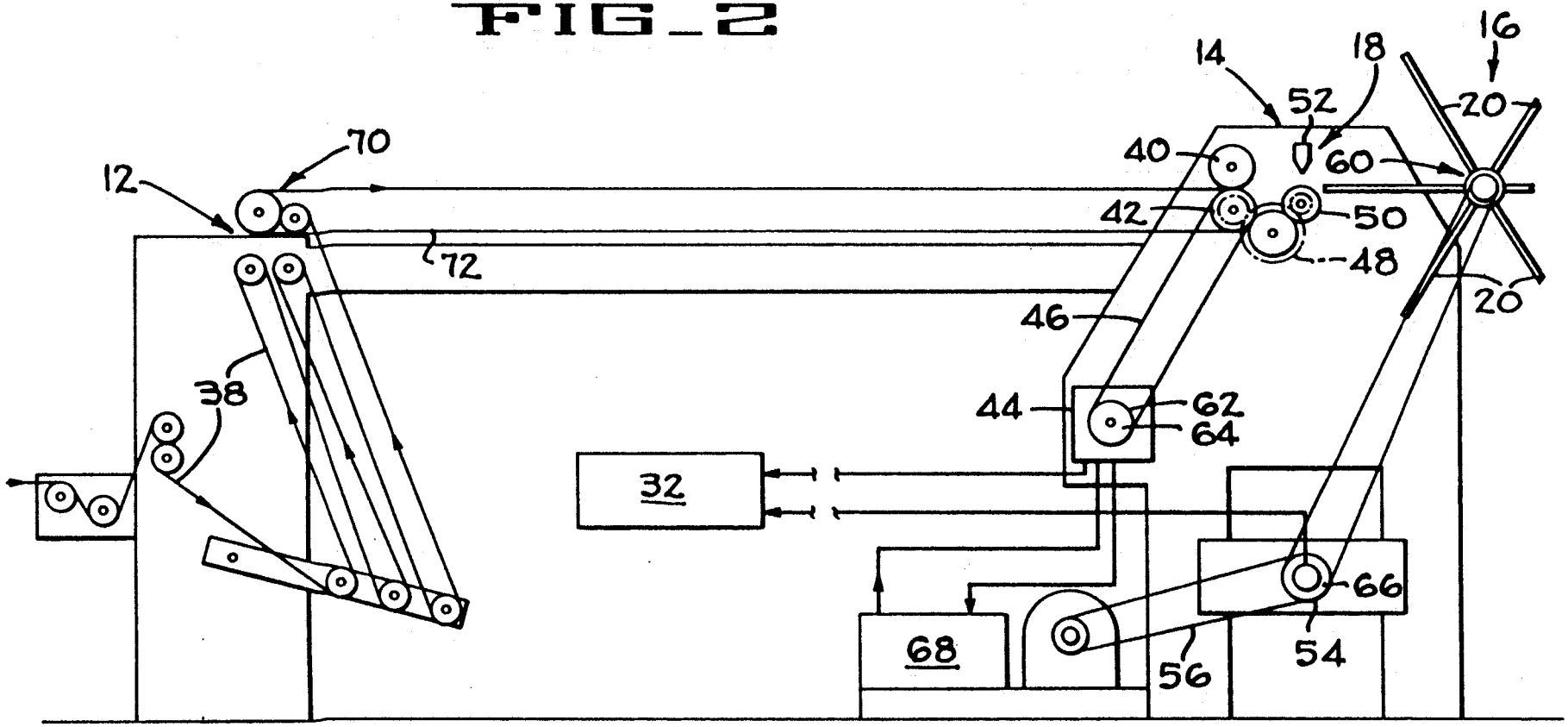
FIG. 2 is a simplistic diagrammatic presentation of the invention utilizing a seal roll index gear.

FIG. 2 pictorially presents one form of the invention. In this figure, a web of film 38 is shown threaded through the tension control and antibounce section, generally 12, to the bag forming section, generally 14. On the bag forming section an upper draw roll 40 and a lower draw roll 42 have the film web held in the nip formed between these draw rolls. The lower draw roll 42 is driven by a servo motor 44 through a belt or chain 46. The lower draw roll means 42 also includes a geared portion that is in engagement with a seal roll index gear means 48 which is in engagement with a seal roll means 50. Thus, the seal roll means 50 and the lower draw roll means 42 are both drivable and driven by the servo motor 44. A seal bar 52 is conventionally cycled vertically by drive linkage means (not shown) from a cam associated with the main drive shaft 54. The main drive shaft 54 will rotate once per machine cycle which is equivalent to once per bag development on a single lane bag machine.

Figure 4:
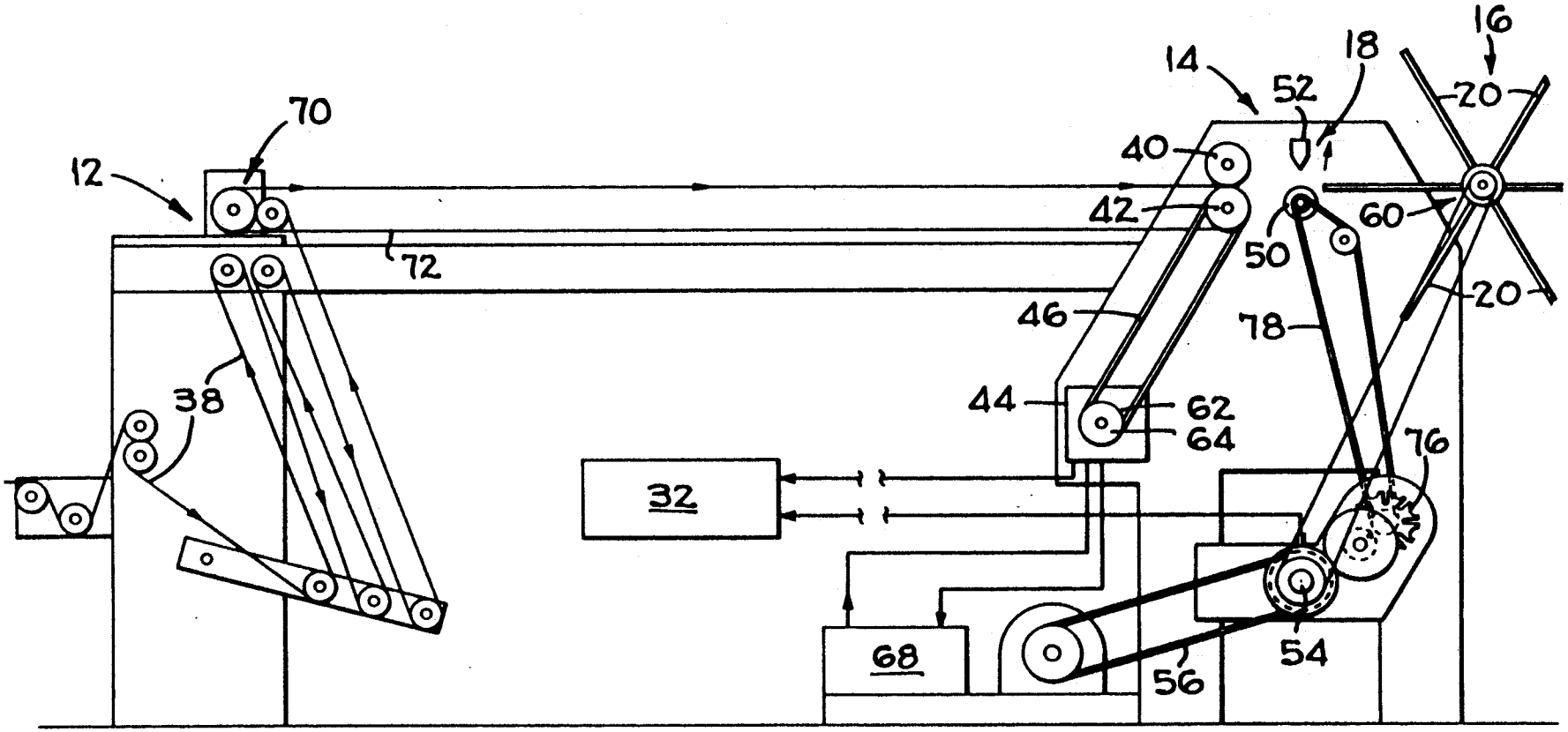
FIG. 4 is a simplified diagrammatic presentation of the invention utilizing a geneva gear means to drive the seal roll.

The vacuum arm assembly 60, which includes machine arms 20, is indirectly driven off the main shaft 54 at some ratio, typically 6:1 in the pictorial FIGS. 2 and 4.

Control elements of the servo motor 44 are provided by a tachometer 62 and a feed back motor encoder 64 mounted on the servo motor, a master shaft encoder 66 on the main drive shaft 54 and a servo amplifier 68, and the operator input device or controller 32. These elements are electrically linked together via various electrical conduits as will be more fully explained when considering FIG. 7.

Also shown in FIG. 2 is an antibounce means 70 which is simplistically shown. The antibounce means 70 is driven by means of a belt 72 which drives the antibounce means at an underspeed from the lower draw roll means 42 which, as pointed out, is driven by the servo motor.

FIGS. 3A and 3B are charts that have been prepared to show the advance that this invention provides over a conventionally driven, that is nonservo driven, bag machine. FIG. 3A presents a graph of the prior art, for instance the applicant's assignee Model 175 bag machine. This is a machine that utilized a clutch/brake means between the main drive and the draw rolls to advance the film web through the bag forming station. The vertical axis of the chart shows web velocity while the horizontal axis is time as expressed in degrees of drive shaft rotation. "Vp" on the velocity scale represents peak web velocity that can be generated by the harmonic bag development cycle using the eccentric crank and rocker linkage and the clutch/brake means of prior art equipment. Due to the inherent operating characteristics of such prior art nonservo driven bag machines, the clutch portion of the machine cycle length is limited to 180° (wherein 360° represents one complete machine cycle) and the machine cycle speed is limited by web acceleration or consequential peak velocity. In the "BRAKE" portion of this chart, representing operation over the 180° to 360° portion of the machine cycle, the sealing of the developed web is accomplished during the "dwell" portion or the braked status of the lower draw roll. Although considerably less than the entire 180° width of the "BRAKE" portion may be necessary to seal the developed web, no more than 180° of the prior art machine cycle can be used for advancing the web. Thus a portion of the machine cycle is wasted and the maximum operating capacity of the machine is limited.

FIG. 3B is a graph showing bag development when the main drive driven clutch/brake mechanism has been replaced with servo motor controlled lower draw roll and seal roll means. By using independent servo motors to control, separately, the lower draw roll and the seal rolls, it is no longer necessary that the web be advanced only during a period comprising no more than 180° of the machine cycle. Rather, (wherein the axes are the same as in FIG. 3A) it can be seen (FIG. 3B) that there is more time, i.e., 230° instead of 180° of machine cycle time, to develop the bag. In particular, the use of independent servo motor drives for the draw and seal rolls enables the machine to use, for web advancement, virtually all the time available in the draw cycle not used for the dwell necessary during the bag sealing operation and a seal clearance time, shown as SC#1 and SC#2, before and after the dwell time when the seal bar is engaged to seal the bag against the platen Provided by the seal roll.

Because the web can now be advanced over a comparatively longer period, the peak acceleration and web velocities (as shown by the solid line in the FIG. 3B chart) are significantly less than would result if the bag was developed in only 180° of draw (shown and represented by the broken line curve starting at 0° and ending at 180°). Since the limiting factor on bag development is primarily the web acceleration, it follows that if the acceleration is decreased by use of the servo driven draw rolls in place of the clutch/brake draw roll actuator, it is possible to increase bag production. This significant improvement can thus be achieved by increasing the speed of the servo draw roll driven bag machine until the acceleration and consequential peak velocity of the servo driven draw roll machines matches the peak acceleration or velocity of the conventional clutch/brake machine.

For example, again referring to FIGS. 3A and 3B, in developing a 9" wide bag at 200 cycles/minute (main drive shaft and machine cycles) with a 40° seal dwell on a prior art machine, the draw time will be approximately 0.15 seconds (180°/360°×0.3 seconds/cycle=0.15 seconds). Peak acceleration will be 1712 inches/second squared for the prior art machine. Expressed differently, if the maximum tolerable web acceleration is 1712 inches/second squared, the maximum allowable operating rate for a prior art machine is 200 cycles/min.

For the servo motor driven machine of the present invention, the same peak acceleration can be substituted into equations of motion for a constant acceleration servo profile to calculate the cycles/minute of the servo draw roll machine running a 9" bag with a 40° dwell.

Holding the peak acceleration as a limit (1712 inches/-second squared) and recognizing that in this example, 230° rather than 180° of machine cycle time is available for drawing the web, 264 cycles can now be performed each minute without exceeding the tolerable peak acceleration. Therefore, 264 cycles/minute are possible when the draw time is 230° rather than 180°. The improvement realized of 64 cycles per minute using the servo driven draw roll in place of the conventional clutch/brake draw roll system is a significant advantage over the prior art.

FIG. 4 illustrates an alternative embodiment to the FIG. 2 embodiment that utilized a seal roll index gear means between the lower draw roll 42 and the seal roll 50. In the FIG. 4 embodiment, wherein like elements have been assigned like reference characters, the seal roll index gear means has been replaced with a well known geneva drive mechanism that drives the seal roll from the main drive shaft 54. FIG. 6 shows the geneva drive assembly in more detail. This drive assembly operates as, for example, an eight step escapement device which receives input from the main drive through belt 56 which drives a gear driven eccentric pin 74 engaged with the geneva escapement gear 76. A belt 78 drives the seal roll 50 in a well known manner. One advantage of the geneva drive over the seal roll index gear means is that there is less inertia in the gear train for the servo motor drive 42 to overcome, therefore, reducing load on the servo motor and its connection to the lower draw roll. The geneva system also allows a separately phaseable indexing of the seal roll.

In the geneva drive embodiment and the seal roll index gear means embodiment it should be noted that the antibounce roll means 70 is driven from the lower draw roll by the belt 72. Of course, as is conventional practice, the antibounce roll means can be left off the machine and other means to control web bounce employed.

FIGS. 5A, 5B, and 5C, is a schematic which shows that the lower draw roll will be indexed in reverse (5B) to pull the web of film 38 off the seal roll 50 by the servo drive means. This will be done during cycle interrupt when a given number of bags, for instance 250 bags, have been cycled through the machine and stacked on the wicket pins 22 so that an empty set of pins can be indexed into place for the next stack of bags. By drawing the web in reverse away from the sealing roll during the cycle interrupt period, the machine 10 avoids repetitive contact between the seal bar and the same portion of the web.

In addition to the limitations on bag development due to acceleration or consequential velocity limits of the film web by the draw rolls, it has been found that a further limitation can exist when removing and stacking bags using the wicket pin and vacuum arm method of stacking bags. This limitation is the clearance between the vacuum arms and a newly developed bag. Once a vacuum arm 20 (FIG. 1) has picked up a bag, the arm must be clear of the leading edge of the next bag. The vacuum or wicket arms 20, have a typical thickness of about one inch at their outboard end. The end of the arm is approximately one inch away from the seal roll 50 on conventional machines and is approximately 20 inches long. In order to clear the next bag, the wicket arm 20 must move approximately 3° to give one inch (the thickness of the vacuum arm) of clearance. With six arm sets, the arms are driven at a 6:1 ratio and thus require 18° of machine cycle for clearance to clear the arm from the leading edge of the next bag prior to next index.

Figure 1A:
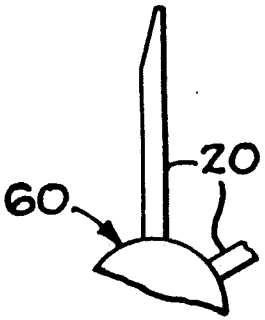
FIG. 1A is a detail of one vacuum arm showing an alternative embodiment having a truncated end.

An improvement in the wicket arms is shown in FIG. 1A wherein a beveled end is formed on the outboard end of the wicket or vacuum arm 20. By beveling the end of the arm, the effective thickness of the arm is reduced allowing the necessary degrees of clearance to be lessened. In the example above, the 3% of our travel necessary to give one inch of clearance can be reduced by making the end of the arm less than one inch in thickness. This also allows longer bag development times as the wicket arms "get out of the way" of the new bag edge more quickly.

A method of ensuring that bags are not developed into the vacuum arms during speed variations is provided by using the servo drive draw roll controls to ensure that the draw time is gradually increased as the main drive increases in speed. To prevent developing bags into the vacuum arms, the servo draw cycle is configured in machine degrees as referenced by the master encoder 66 only and not in real time. The draw roll speed is matched to the main drive speed through the master encoder and the feed back controller 64 operating the servo motor under the control of the motion controller. Thus, upon machine start up the draw starts out slowly and follows the main drive speed until the main drive gets up to speed. The draw speed will follow the main drive speed up rather than get ahead of it as in prior art. This will be discussed in greater detail below with reference to FIG. 10.

FIG. 7 presents a flow chart of the relationship between the control elements of the servo drive draw roll machine. The master position encoder is the master shaft encoder 66 which also provides a zero marker relevant to the main drive shaft. The encoder signal is directed to the master encoder interface which processes the signal to the machine timing module which determines the amount of time in machine degrees available for the profile generator.

The generated profile is sent to the command generator which through the servo translator directs the servo amp to energize the servo motor to drive the lower draw roll. The servo motor tachometer feeds back the servo motor speed to the servo amp while the web position feed back encoder 64 loops back to the servo translator which will, upon reaching the desired degrees of draw, signal the profile generator that the draw is complete. (The master encoder interface, machine timing module, command generator and profile generator all reside in the motion controller 32.)

The elements contained in the broken line boxes are alternative embodiments for arriving at commanded draw length. The left box is for use when the film being made into bags is preprinted and is thus print registered. The registration control will determine draw length after checking print markers on the film. The right box is an operator controlled draw length selection where the operator will input a desired bag draw length.

An alternative embodiment of the invention 100 is shown in FIGS. 8–13, in the embodiment, the seal head is operated by an independent servo motor rather through a cam driven mechanical linkage. In addition, a "single roll dancer" is included as is an improved mechanism for indexing the sealing roll, finally, an improved anti-jamming stripper finger assembly has been included. Each of these features will be described in the discussion that follows.

FIGS. 8A-8D show different configurations of the servo driven seal head. The machine 100, in accordance with one aspect of the invention, uses servo control technology in the form of a servo controlled motor or valve driving a linkage to raise and lower the seal head to provided a real time seal dwell that is electronically adjustable. Means are provided for stopping the seal head motion electronically during cycle interrupt thus eliminating the need for film reversal. The machine also includes means for electronically adjusting the seal head penetration into the sealing roll or platten.

As shown in FIGS. 8A and 8B, the machine 100 utilizes an eccentric linkage 102 driven by a servo motor 104 to provide an oscillatory rather than rotary motion to a pivot shaft 106 that is linked to push rods 108 to raise and lower the seal head 110 in a reciprocating manner. The servo motor 104 drives an eccentric shaft 112 through a timing belt 114. The eccentric shaft 112 is pinned to a connecting link 116 which is also pinned to a follower link 118 which is clamped to the pivot shaft 106. Rotation of the eccentric shaft 112 causes an oscillatory motion of the follower link 118 similar to a crank rocker linkage, which also causes an oscillatory motion of the pivot shaft 34 to which the follower link 118 is clamped. Clamp arms 120 transmit the oscillatory motion of the pivot shaft 106 to the push rods 108 which results in the vertical reciprocating motion of the seal head 110. Extension springs 122, attached to an additional clamp arm 124 aid in lifting the seal head 110. One half of a revolution of the eccentric shaft 112 results in the downward motion of the seal head 110. The seal and cut off of the bag is performed while the seal head is in the down or dwell position. The amount of seal dwell time is electronically controlled in an independent manner by holding the servo motor 104 in position such that the seal head 110 is in contact with the sealing platten or roll for a specified period of time. The period of time or dwell while the seal is being made is servo controlled and is electronically selectable. The servo machine cycle is configured such that the seal dwell time is constant regardless of machine cycle speed. Once the seal dwell time is completed the servo motor 104 tuns the eccentric shaft 112 one half of a revolution to raise the seal head away from the seal roll to provide clearance for the next bag to be developed. During cycle interrupt the seal head is held in the up position so that film reversal is not necessary.

Figure 8C:
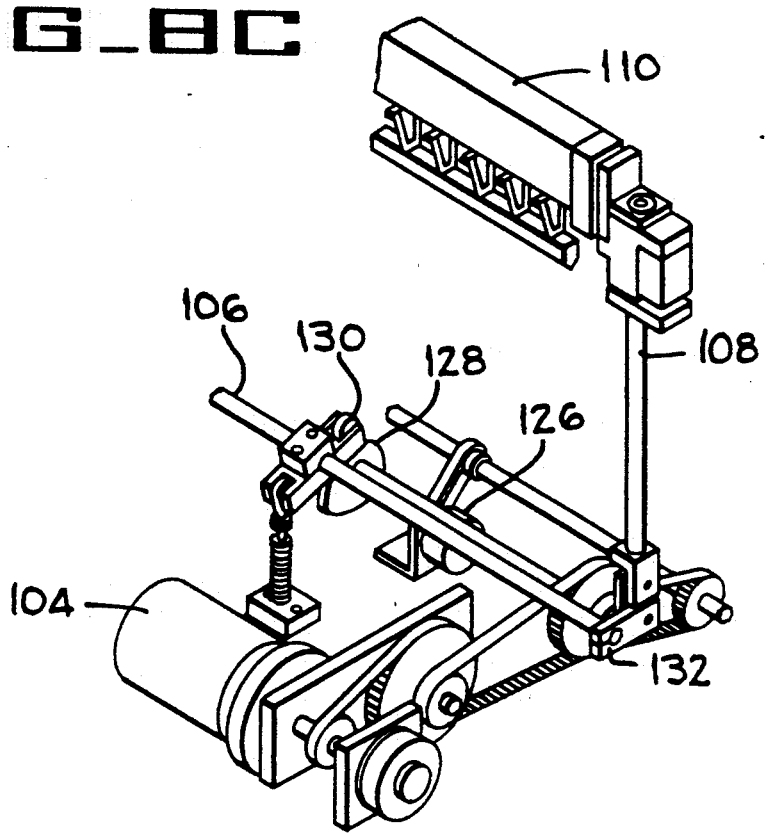

FIG. 8C shows an alternative embodiment wherein the servo motor 104 drives a cam shaft 126 with a single cam 128 actuating a cam follower 130 which is clamped to the pivot shaft 106 to provide oscillatory motion of the pivot shaft 106. Arms 132 located at the ends of the pivot shaft 106 transmit the oscillatory motion of the pivot shaft 106 to the push rods 108 which cause the seal head 110 to move in a vertical reciprocating motion. The dwell time is adjustable by setting the amount of time the servo motor 104 stays in position such that the seal bar is down on the seal platten or roll. During cycle interrupt, the servo motor 104 is held in a position such that the seal head does not touch the seal roll thus eliminating the need for film reversal.

Figure 8D:
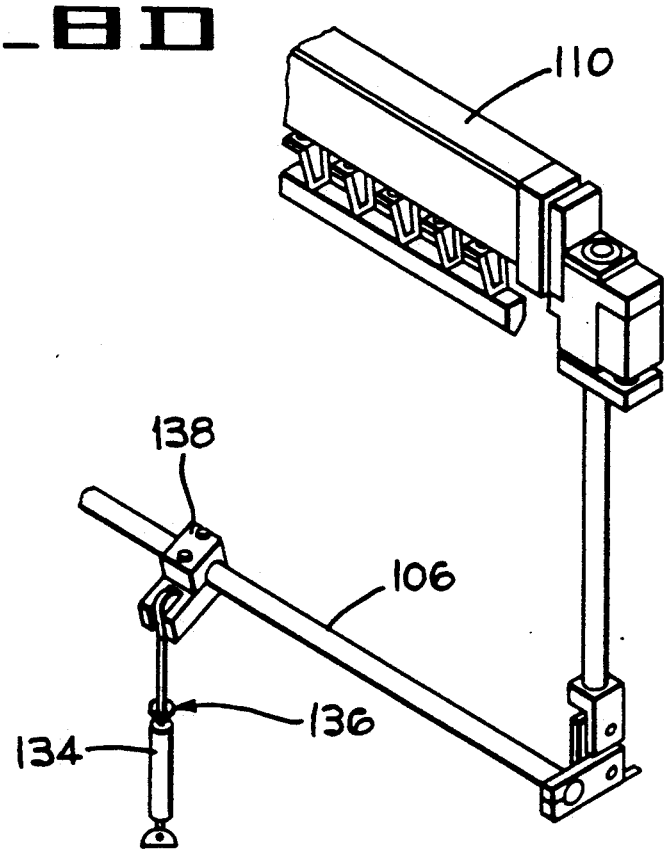

FIG. 8D shows still another alternative embodiment implemented using a servo controlled valve to control the motion of a pneumatic, hydraulic, or any kind of fluid cylinder. The position of the fluid cylinder 134 position is controlled electronically by a servo valve. The fluid cylinder is equipped with an LVDT of know construction or other feedback device 136 to provide velocity and position feedback to close the servo loop. The stroke of the cylinder 134 through a clamp 138 imparts an oscillatory motion on the pivot shaft 106 which, through a linkage provides the vertical reciprocating motion of the seal head 110. The seal dwell time is controlled by the amount of time that the cylinder is allowed to stay in position such that the seal head is against the seal platten or roll. This position is controlled by the servo valve. In this implementation seal penetration can also be controlled by position feedback and servo control of the cylinder through the servo valve. The stroke of the cylinder can be electronically controlled to vary seal bar penetration.

Although a specific example of the servo driven seal head has been shown and described, it will be appreciated that other methods or linkages incorporating the use of a servo controlled valve or motor through a linkage to drive a reciprocating seal head on an intermittent style bag making machine can be employed. Moreover, it should be appreciated that the use of separate servo motors provides the ability to independently control the motion and position of selected portions of the bag machine 10.

FIG. 9 is a simplified block diagram of the servo control system incorporated in the alternative embodiment bag machine 100. The servo system generally consists of a servo device 140, (typically a valve or motor), a servo amplifier 142, a master encoder 144, and a servo controller 146. The master encoder 144 provides machine position feedback to the servo controller 146. This position feedback gives the servo controller 146 a reference for machine timing functions and servo command timing. The servo controller 146 sends a predetermined velocity and position command to the servo amplifier 142 which then sends a command to the servo device 140 causing it to move in accordance with the motion command. The servo device 140 has position and velocity feedback to form a closed servo loop system. This closed loop servo control theory is well known in the art and need not be described in great detail.

The structure disclosed herein provides an improved seal head lift mechanism that uses servo control technology through the use of servo motors and/or valves through a linkage to replace the conventional cam driven seal head lift that is well known in the art.

In accordance with another aspect of the invention, means are provided for ratioing or coordinating the draw speed of the servo draw roll drive to the speed of the vacuum pickup arm 20 (FIG. 1) of a wicket stacker. Typically, it takes several machine cycles for the wicket vacuum arms to accelerate to the set operating speed of the machine. On the other hand, the servo driven draw rolls require much less time to reach operating speed. Thus, bags can be developed much faster than the wicket stacker portion of the machine can reach maximum speed. To avoid asynchronization problems, the speed of the draw rolls is synchronized with the speed of the stacker to avoid jamming of the film into, or interferences of the film with, the pickup arms. To this end the servo controller is programmed to compare position feedback from the master encoder and the servo draw roll drive motor encoder and adjust the command to the servo amplifier accordingly. The servo control loop will be better understood by reference to FIG. 10.

FIG. 10 shows a schematic of the servo control loop that embodies the ratioing means. A master encoder 148 relates the absolute machine position to a servo controller 150 to coordinate all machine timing functions. Reading the absolute master encoder position, the servo controller 150 sends a predetermined draw command to a servo amplifier 152 which then commands the servo motor 44 to execute the commanded motion. The servo motor 44 is equipped with position and velocity feedback to close the servo loop. The servo controller 150 through its programmed software reads the position feedback signal from the servo motor 44 and compares the signal to the absolute machine position obtained from the master encoder 150. The servo controller 150 adjusts the command to the servo amplifier so that the draw motor speed is synchronized with the wicket stacker speed. Essentially this allows the drive roll speed to follow the speed of the wicket stacker drive motor so that they are always synchronized, thus avoiding interference with the wicket pick up arms upon start up or sudden speed changes.

To eliminate web bounce, yet maintain web storage capabilities, the alternative embodiment bag machine 100 includes a tension control and antibounce section 154. This section preferably includes a "single roll dancer" 156 as shown in FIG. 11. The antibounce section 154 functions to respond to intermittent web draw and to store the film web during cycle interrupt. As illustrated, the antibounce section 154 includes two separate dancer portions 158, 160 in series. The first portion 158 functions to provide "storage" and the second portion 160 functions to provide "response". The influence of one dancer portion on the other can be a major problem, and means are provided for isolating the dancer portions from each other.

In the illustrated embodiment, dancer isolation is provided by means of a fluid cylinder 162 configured to provide damping in one direction. The fluid cylinder 162 with two way flow control is attached to the storage dancer 158. The flow controls on the cylinder are set in such a way that upward motion of the dancer 158 is restricted but downward motion is not. During normal operation of the machine (noninterrupt periods) the storage dancer 158 is restricted by the fluid cylinder 162 from responding to the intermittent draw and all of the response to the intermittent draw is taken up by the response dancer 160. During the draw interrupt periods, the storage dancer 158 moves downward to accumulate the web material from the constant velocity web infeed. The storage dancer 158 is free to travel in the downward direction for storage but has restricted travel in the upward direction to limit its response from the intermittent draw and isolate it from the response dancer.

The storage rollers 158 are mounted on a pivoting arm 164 that pivots in the clockwise direction (as shown in FIG. 11) as the web is being stored. The arm 164 is coupled to a sensor, such as a potentiometer, that controls the speed of the infeed or unwind rolls 166 in accordance with the angular position of the arm. As web accumulates, the arm 164 moves in the clockwise direction causing the speed of the infeed rolls to decrease. When the arm 164 reaches the full clockwise position, the infeed rolls stop to avoid overaccumulation of the web.

Following the sealing operation, it is possible for the heat sealed web to adhere to the seal roll 50. To avoid jamming and other difficulties caused by such adhesion, as well as to ensure uniform wear of the seal roll 50, means are provided to index or rotationally displace the seal roll 50 by a predetermined angular displacement upon each machine cycle. To this end, the bag machine 100 includes a seal roll indexing drive 168 as illustrated in FIG. 12.

As seen in FIG. 12, a block 170 is mounted to the pivot shaft 106 which, during operation of the machine, oscillates over a fixed, predetermined angular rotation. The block 170 is connected to one end 171 of a flexible belt 172, the other end 173 of which is connected to one end 175 of a spring 174. The other end 176 of the spring is connected to a fixed point, such as the machine frame, and the belt 172 is looped over a one-way drive or clutch 178 coupled to the seal roll 50. In the embodiment illustrated in FIG. 12, rotation of the one-way clutch 178 in the clockwise direction (clutch engaged) results in clockwise rotation of the seal roll 50, while rotation of the one-way clutch in the counterclockwise direction (clutch disengaged) results in the seal roll 50 remaining stationary.

In operation, oscillation of the pivot shaft 106 in the clockwise direction causes the block 170 to pull the end of the belt 172 in the downward direction against the tension of the spring 174. Such movement of the belt causes the one-way clutch 178 to rotate in the counterclockwise direction. As the clutch is disengaged during such clockwise rotation, the seal roll 50 remains stationary. As the pivot shaft 106 rotates in the counterclockwise direction, tension on the belt 172 is relieved and the belt moves in the opposite or upward direction as the spring 174 contracts. This results in clockwise rotation of the clutch 178, and, accordingly, clockwise rotation of the seal roll 50. In this manner, the seal roll 50 is angularly displaced or indexed by a fixed amount during each machine cycle. Preferably, the seal roll 50 is indexed by approximately 15° during each machine cycle.

To avoid jamming caused by undesired adhesion of the web to the draw rolls 40, 42, the bag machine 100 includes a plurality of stripper fingers 180 that, as best seen in FIGS. 13*a*–13*e*, normally reside within circumferencial grooves 182 formed in the draw roll assembly and function to strip the web from the draw rolls. Occasionally, it is possible for the web to nevertheless adhere to the draw rolls 40, 42 and jam against the stripper fingers 180 in an abnormal fashion.

To avoid exacerbating the consequences of an abnormal jam, the bag machine 100, in accordance with a further aspect of the invention, includes means for automatically disabling the draw rolls in the event of jamming. To this end, at least some of the stripper fingers 180 are mounted to a bracket 184 that, in turn, is pivotally attached to the machine frame 186. In addition, an electrical switch 188, responsive to sufficient pivoting movement of the bracket 184 relative to the frame 186, controls actuation of the draw rolls 40, 42.

During normal unjammed operation of the machine 100, the pivotal position of the bracket 184 is such that the switch 188 permits actuation of the draw rolls 40, 42. In the event the web jams in the vicinity of the draw rolls 40, 42, the bracket 184 pivots, actuating the switch 188 and thereby stopping the draw rolls 40, 42. Such operation provides a rapid shutdown of the machine in the event of an abnormal jam condition.

What has been disclosed herein is an improved bag making machine that generally use servo motors for selectively driving bag machine components independent of other components and particularly uses a servo driven draw roll and a servo driven seal bar assembly.

Nuances of the invention that are obvious to those having skill in the art of bag making machine design are contemplated as being covered by the following claims.

What is claimed is:

1. A bag making machine having a plurality of components including means for supplying a film web, a draw roll for drawing said film web from said supply means, a seal roll and seal bar for cooperatively sealing said drawn film web and motion control means for generating signals to control electrical and mechanical operation of said bag machine, the improvement comprising a servo motor responsive to said signals from said motion control means for controlling the position and motion of said seal bar, said motion control means programmed for operation in at least the mode of using said servo motor to control the position and motion of said seal bar independent of the motion of said remaining plurality of components.

2. A bag making machine having a plurality of components including means for supplying a film web, a draw roll for drawing said film web from said supply means, a seal roll and seal bar for cooperatively sealing said drawn film web, seal roll index means for providing incremental rotary motion to said seal roll and motion control means for generating signals to control electrical and mechanical operation of said bag machine, the improvement comprising a servo motor responsive to said signals from said motion control means for controlling the position and motion of said seal bar and said seal roll index means, said motion control means programmed for operation in at least the mode of using said servo motor to control the position and motion of said seal bar in association with said seal roll index means independent of the motion of said remaining plurality components.

* * * * *